United States Patent [19]

DePaul

[11] Patent Number: 4,838,432

[45] Date of Patent: Jun. 13, 1989

[54] CARTON AND BLANK FOR PACKAGING ICE CREAM AND THE LIKE

[75] Inventor: Richard E. DePaul, Williamsburg, Va.

[73] Assignee: Somerville Packaging Corporation, Newport News, Va.

[21] Appl. No.: 203,122

[22] Filed: Jun. 7, 1988

Related U.S. Application Data

[63] Continuation-in-part of Ser. No. 106,877, Oct. 13, 1987, Pat. No. 4,757,902.

[51] Int. Cl.[4] ..... B65D 5/54

[52] U.S. Cl. ..... 206/632; 206/611; 206/624; 229/145; 229/905

[58] Field of Search ..... 229/132, 135, 145, 154, 229/169, 3.1, 905; 206/611, 624, 629, 631, 626, 632

[56] References Cited

U.S. PATENT DOCUMENTS

| | | | |
|---|---|---|---|
| D. 293,211 | 12/1988 | DePaul | D9/416 |
| 3,144,980 | 8/1964 | Larson | 229/51 |
| 3,165,254 | 1/1965 | Moore | 229/51 |
| 3,197,114 | 7/1975 | Holmes | 229/51 |
| 3,206,915 | 9/1965 | Anderson | 53/374 |
| 3,219,257 | 11/1965 | Anderson | 206/611 |
| 3,281,055 | 10/1966 | Buttery | 229/51 |
| 3,281,059 | 10/1966 | Buttery et al. | 206/624 |
| 3,298,595 | 1/1967 | Collura | 206/631 |
| 3,315,870 | 4/1967 | Barnes | 206/624 |
| 3,353,740 | 11/1967 | Outwater | 229/51 |
| 3,756,501 | 9/1973 | Skillen et al. | 206/631 |
| 3,758,023 | 9/1973 | Meyers | 206/611 |
| 3,797,728 | 3/1974 | Buttery et al. | 206/624 |
| 3,833,165 | 9/1974 | Hoiles | 229/37 R |
| 4,046,313 | 9/1977 | Perry | 206/611 |
| 4,113,102 | 9/1978 | Mueller | 206/611 |
| 4,239,115 | 12/1980 | Froom | 206/611 |
| 4,549,689 | 10/1985 | Bailey | 206/631 |
| 4,555,027 | 11/1985 | Froom | 206/626 |
| 4,669,614 | 6/1987 | Froom | 206/626 |
| 4,712,689 | 12/1987 | Froom | 206/626 |
| 4,756,470 | 7/1988 | DePaul | 229/134 |
| 4,757,902 | 7/1988 | Hutchinson | 206/626 |

*Primary Examiner*—David T. Fidei
*Assistant Examiner*—Gary E. Elkins
*Attorney, Agent, or Firm*—Shlesinger & Myers

[57] ABSTRACT

A carton for packaging ice cream and the like comprising a receptacle including operably connected front, bottom and rear panels. A cover having a cover panel and a closure flap is hingedly connected to the receptacle for sealing the carton. The front, bottom, rear and cover panels each have left and right end flaps operably connected to their left and right edges. The end flaps are dimensioned such that upon folding they form substantially sealed left and right cartons ends. In the preferred embodiment, a breakaway tab is detachably formed in the cover panel end flap. The front surface of the breakaway tab is secured to the rear panel end flap so as to minimize any gaps between the end flaps forming the carton ends. The breakaway tab extends through only a portion of the thickness of the cover panel end flap. Upon initial opening of the carton, the breakaway tab is severed from the cover panel end flap permitting the consumer to readily gain access to the contents of the carton.

12 Claims, 5 Drawing Sheets

FIG 9
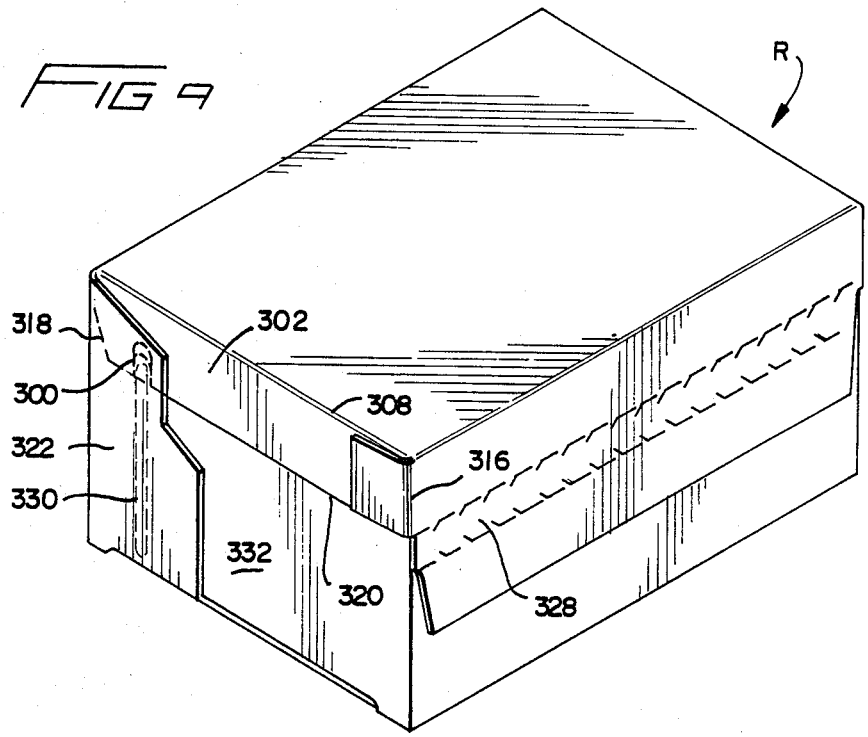
FIG 11
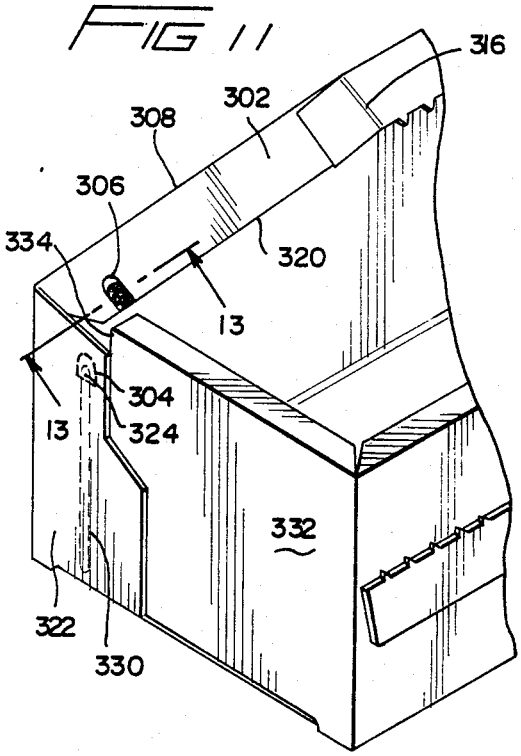
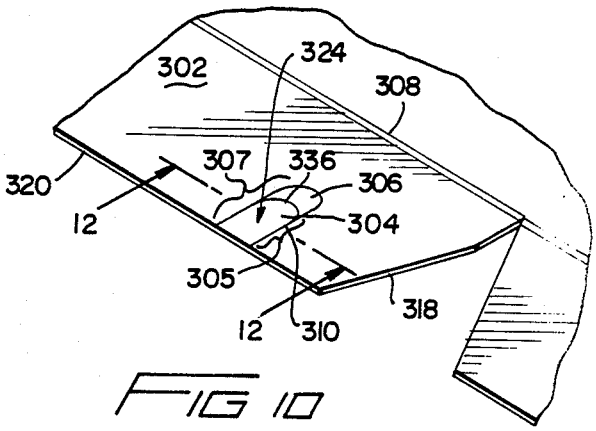
FIG 10
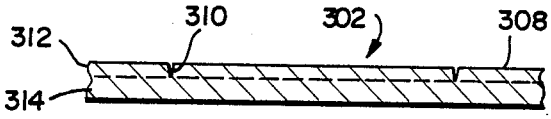
FIG 12
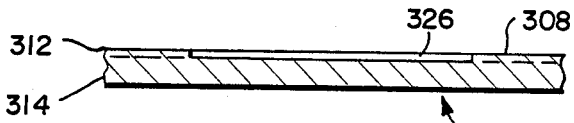
FIG 13

CARTON AND BLANK FOR PACKAGING ICE CREAM AND THE LIKE

The present application is a continuation-in-part of my earlier-filed copending application Ser. No. 106,877, filed Oct. 13, 1987, now Pat. No. 4,757,902 issued 7/19/88.

BACKGROUND AND FIELD OF INVENTION

There are at least two fundamental requirements for cartons used for packaging ice cream and the like. The carton must be esthetically pleasing to the consumer. Secondly, the seal of the carton must be such that it prevents liquids or semi-liquids from leaking from the ends thereof.

In an effort to enhance the overall appearance of ice cream cartons it has been known to print, on the exterior of the carton, scenes depicting enticing scoops of ice cream and the like. The premise being the more attractive and alluring the carton is the more likely the consumer is to purchase the ice cream. The body panels of the carton provide a substantially continuous surface which readily receives printing thereon. The ends of the carton, however, are formed generally from four end flaps extending from the body panel. In previously known ice cream cartons, the end flaps when folded-in formed a very irregular surface. Gaps or spaces exist between the various end flaps. These gaps and irregularities in the carton ends detract significantly from the overall appearance of the carton. More specifically, the gaps make it very difficult to display a unified scene on the carton ends. Thus, valuable advertising space is lost or not utilized to its fullest potential.

The presently known process for packaging ice cream makes it essential that a carton have a sufficient seal to prevent semi-liquids or liquids from leaking therefrom. During the process of packaging ice cream, a carton is customarily erected wherein one of the carton ends is sealed and the other carton end is open. A filling instrument is positioned above the open end and dispenses ice cream in a semi-liquid or liquid state into the carton. The carton is then sealed and passed along a conveyor system through a chiller or refrigeration unit wherein the ice cream is solidified. The seal of the carton must be adequate to ensure against leakage from the time that the semi-liquid or liquid is dispensed into the carton until the time the ice cream solidifies. Previously known cartons contain gaps between the end flaps folded inwardly to form the carton ends. These gaps allow semi-liquids or liquids to leak from the carton and form residue on its exterior surface. The residue solidifies during the refrigeration process. These cartons must be disposed of because they project an image of damaged goods.

The present invention discloses an ice cream carton that eliminates the above disadvantages of previously known ice cream cartons.

OBJECTS AND SUMMARY OF THE INVENTION

It is a primary object of the present invention to provide an improved carton for packaging ice cream and the like.

Another object of the present invention is to provide the ends of a carton with a breakaway tab for eliminating the gaps between the end flaps forming the carton ends.

A further object of the present invention is to provide a carton that can be readily resealed by the consumer upon initial opening thereof.

Still another object of the present invention is to provide a carton having a breakaway tab formed in an end flap such that the carton can be resealed after the tab has been severed from the respective end flap.

Yet another object of the resent invention is to provide a carton that can be manufactured in multiples, from a web or sheet stock, with minimum waste or scrap produced during the blanking operation and efficient nesting of one blank against another.

A further object of the present invention is to provide a carton including ends having a substantially continuous surface for displaying printed matter formed thereon.

Yet another object of the present invention is to provide a carton with an improved seal for preventing residue from forming on the outer surface thereof.

Another object of the present invention is to provide a carton blank that can be readily erected by mechanical means without residue forming on the outer surface of the carton.

A further object of the resent invention is to provide a breakaway tab that is hidden from view when the carton is sealed.

Another object of the present invention is to provide a breakaway tab formed in an end flap forming the carton end such that upon severance of the breakaway tab, the end flap maintains substantially the same outer peripheral area.

Yet another object of the present invention is to provide a breakaway tab that is formed only in a portion of the thickness of an end flap forming a carton end.

Still another object of the present invention is to provide a unique breakaway tab formed only in a portion of the thickness of an end flap forming a carton end that s easily severed therefrom and which does not leave behind a portion remaining attached to the end flap when the carton is initially opened.

In summary, the present invention discloses a novel design form a carton blank having a breakaway tab formed in each of the ends of the carton form eliminating gaps between the end flaps forming the carton ends thereby improving the seal and the overall appearance of the carton.

DESCRIPTION OF THE DRAWINGS

FIG. 9 is a perspective view of the sealed carton according to a sixth embodiment of the present invention.

FIG. 10 is a fragmentary perspective view of the carton of FIG. 9 showing the cover panel end flap with the breakaway tab.

FIG. 11 is a fragmentary perspective view of the carton according to the sixth embodiment formed in accordance with the present invention.

FIG. 12 is a cross-sectional view of the carton taken along line 12—12 of FIG. 10.

FIG. 13 is a cross-sectional view of the carton taken along line 13—13 of FIG. 11.

DETAILED DESCRIPTION OF THE INVENTION

Figure 1:
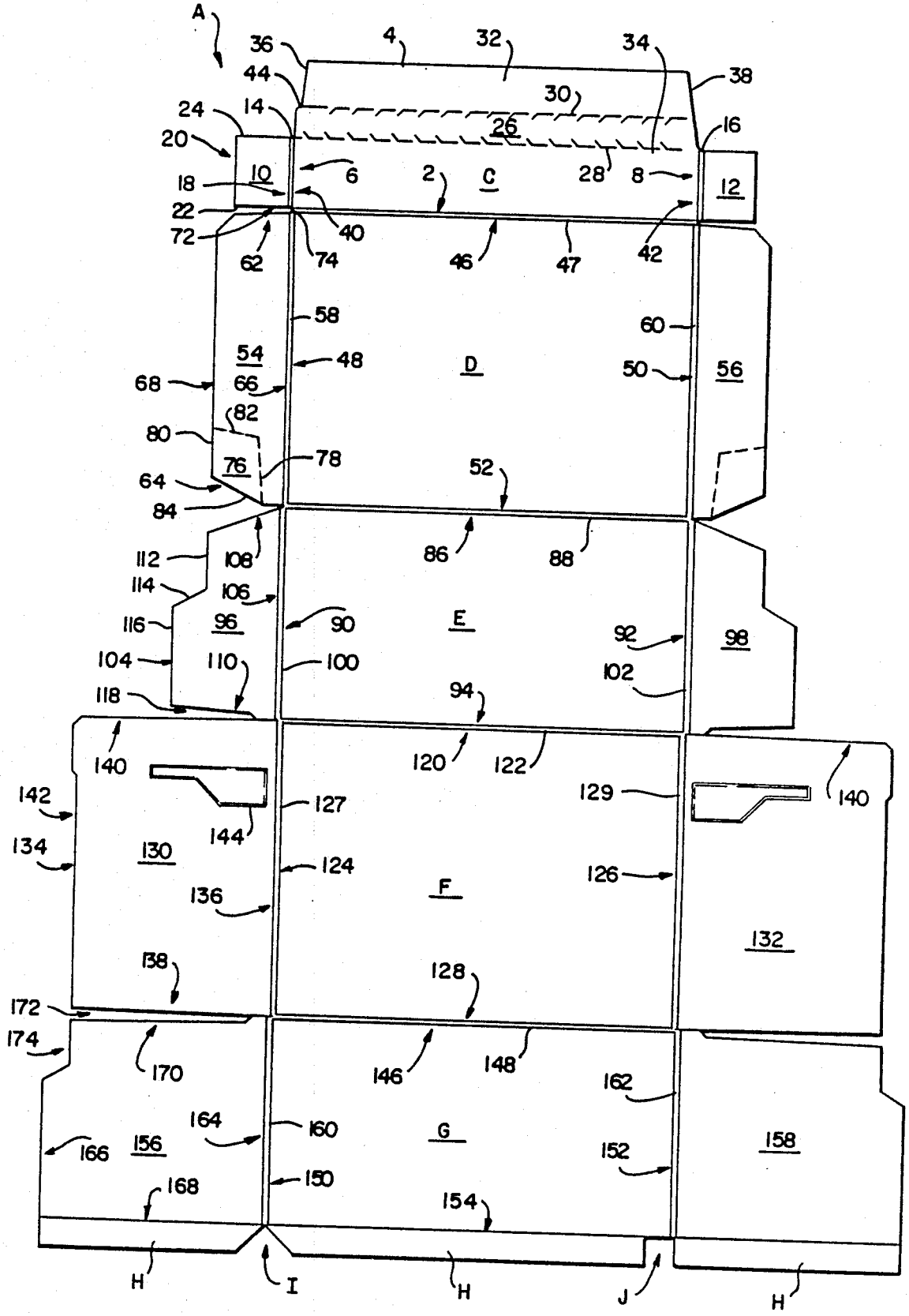
FIG. 1 is a plan view of the inner surface of a flat carton blank formed in accordance with the present invention.
Figure 2:
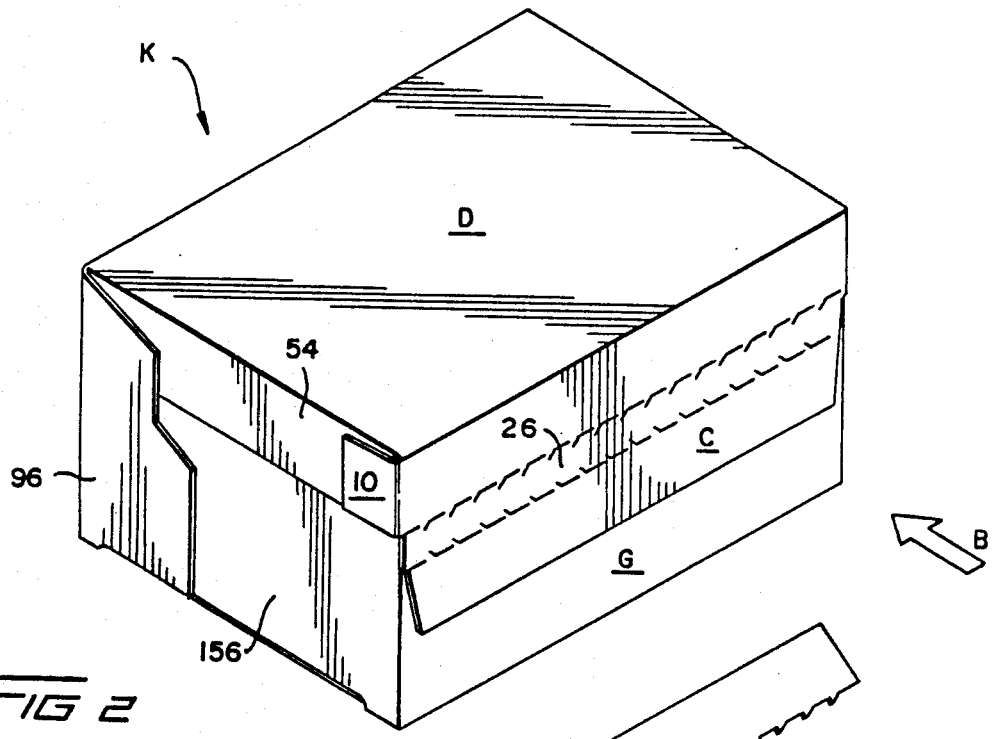
FIG. 2 is a perspective view of the sealed carton.
Figure 3:
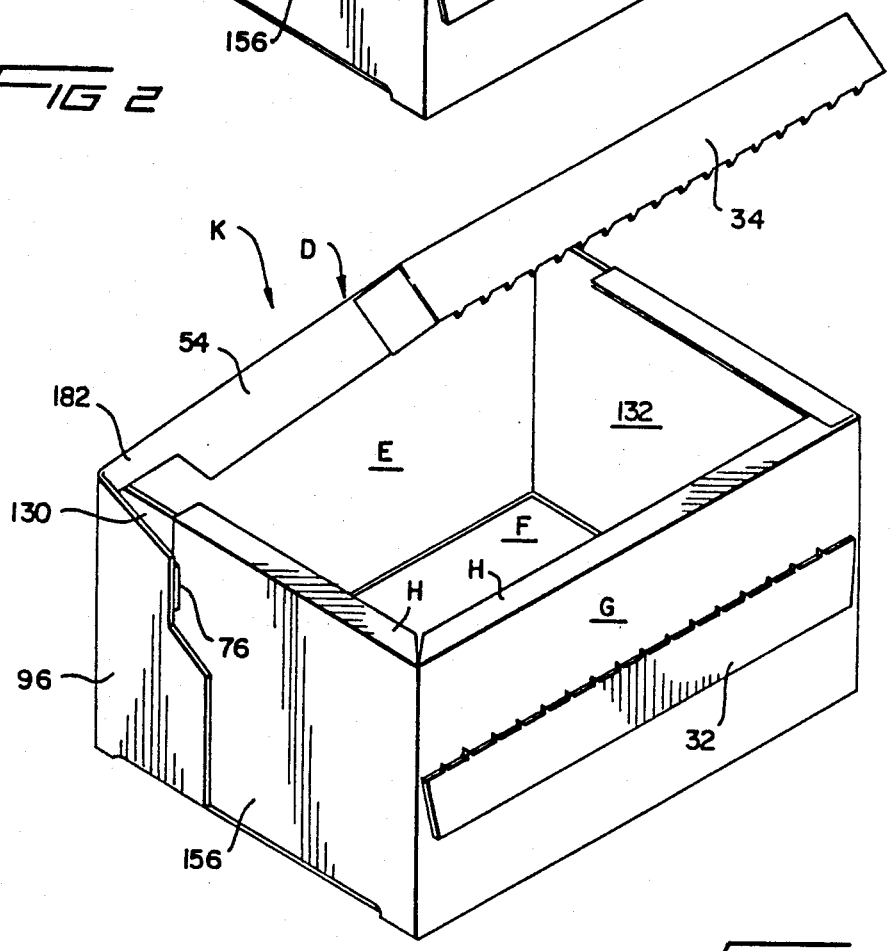
FIG. 3 is a perspective view of the carton formed in accordance with the present invention with the tear strip and breakaway tab removed from the cover panel.

Referring to FIG. 1, the specific nomenclature assigned to each component and subcomponent comprising carton blank A refers to its orientation when carton blank A is fully erected and as viewed in the direction of arrow B in FIG. 2. The carton blank A comprises a closure flap C, a cover panel D, a rear panel E, a bottom panel F and a front panel G. Closure flap C includes a top edge 2, a bottom edge 4, a left edge 6 and a right edge 8. Left and right cover or glue tabs 10 and 12 are hingedly connected to left and right edges 6 and 8 respectively forming vertically extending hinge lines 14 and 16 therebetween. Cover tabs 10 and 12 include front edge 18, rear edge 20, top edge 22 and bottom edge 24. Top edges 22 extend substantially parallel to bottom edges 24. Further, rear edges 20 extend substantially parallel to and are joined to the corresponding hinge lines 14 and 16.

A tear strip 26 is formed in closure flap C. The tear strip 26 includes weakness lines 28 and 30 which subdivide closure flaps C into a glue panel 32 and a skirt or releasable flap 34. Glue panel 32 includes left and right ends 36 and 38, respectively. Skirt 34 includes left and right ends 40 and 42, respectively. Left and right end 40 and 42 extend substantially parallel to corresponding hinge lines 14 and 16. Left end 36 of glue panel 32 is positioned inwardly from left end 40 of skirt 34 thereby permitting the consumer to readily access tab 44 of tear strip 26. Right end 38 of glue panel 32 forms an obtuse angle less than 180° with right end 42 of skirt 34. It will be readily appreciated that various types of tear tabs and tear strips may be used.

Cover panel D is hingedly connected at its front edge 46 to top edge 2 of closure flap C forming therebetween hinge line 47. Cover panel D further includes left edge 48, right edge 50 and rear edge 52. Left and right end flaps 54 and 56 are hingedly connected to left and right edges 48 and 50 respectively forming hinge lines 58 and 60 therebetween. Hinge lines 58 and 60 are offset inwardly from corresponding hinge lines 14 and 16.

Cover panel end flaps 54 and 56 include front, rear, top and bottom edges 62, 64, 66 and 68, respectively. Front edges 62 are spaced from the corresponding top edges 22 of glue tabs 10 and 12, and form an acute angle with the corresponding hinge lines 58 and 60. Notches 72 are formed between glue tabs 10 and 12 and the associated cover panel end flaps 54 and 56. Notches or recesses 72 include an arcuate radius 74 formed adjacent hinge lines 58 and 60. Breakaway tabs 76 are formed adjacent rear edges 64 of cover panel end flaps 54 and 56. Breakaway tabs 76 are defined by perforation cuts or score line and include top, bottom, front and rear edges 78, 80, 82 and 84, respectively. The top edge 78 is spaced from top edge 66 of cover panel end flap 54 and 56. The perforated cuts or score lines extend through the thickness of the blank A. Thus, the tear tabs 76 can be readily detached from the cover panel end flaps 54 and 56.

Rear panel E is hingedly connected at its top edge 86 to rear edge 52 of cover panel D forming therebetween hinge line 88. Rear panel E further includes left edge 90, right edge 92 and bottom edge 94. Left and right rear panel end flaps 96 and 98 are hingedly connected to left and right edges 90 and 92 of rear panel E, respectively. Vertically extending hinge lines 100 and 102 are formed between rear panel E and left and right rear panel end flaps 96 and 98. Hinge lines 100 and 102 are outwardly offset from corresponding hinge lines 58 and 60.

Rear panel end flaps 96 and 98 include front, rear, top and bottom edges 104, 106, 108 and 110, respectively. Front edges 104 form an acute angle with corresponding hinge lines 100 and 102. Top edges 108 include first, second and third sections 112, 114 and 116, respectively. First sections 112 form an obtuse angle less than 180° with top edges 108 and extend parallel to corresponding hinge lines 100 and 102. Second sections 114 extend angularly form first sections 112 and form an obtuse angle greater than 180° therewith. Third sections 116 extend parallel to corresponding hinge lines 100 and 102. Further, sections 116 form an obtuse angle of less than 180° with second sections 114. Bottom edges 110 have a cut out 118 formed therein.

Bottom panel F is hingedly connected at its top edge 120 to bottom edge 94 of rear panel E forming hinge line 122 therebetween. Bottom panel F further includes left edge 124, right edge 126 and right edge 128. End flap 130 and 132 are hingedly connected to left and right edges 124 and 126 respectively forming hinge lines 127 and 129 therebetween. The hinge lines 127 and 129 are offset inwardly from the corresponding hinge lines 100 and 102. Left and right front panel end flaps 130 and 132 include top, bottom, front and rear edges 134, 136, 138 and 140, respectively. Cut-outs 142 are formed in top edges 134. Further, bottom panel end flaps 130 and 132 include an embossed portion 144 formed therein. The cut-outs 142 and embossed portions 144 are more fully described in copending patent application Ser. No. 07/021,649, the entire disclosure of which is hereby incorporated by reference. The widths of end flaps 130 and 132 are substantially equal to exterior width of bottom panel F.

The front panel G is hingedly connected at its bottom edge 146 to front edge 128 of bottom panel F forming hinge line 148. Front panel G further includes left edge 150, right edge 152 and top edge 154. End flaps 156 and 158 are hingedly connected to left and right edges 150 and 152, respectively. Hinge lines 160 and 162 are formed therebetween. Hinge line 160 and 162 are offset outwardly from corresponding hinge lines 127 and 129.

Front panel end flaps 156 and 158 include front, rear, top and bottom edges 164, 166, 168 and 170, respectively. Bottom edges 170 each have a notch 172 formed therein. Notches 174 are formed in rear edges 166 of front panel end flaps 156 and 158. Notches 174 cooperate with embossing sections 144 in the manner described in the aforementioned copending patent application. Membrane flaps H extend from top edges 168 of front panel end flaps 156 and 158 and top edge 158 of front panel G. Notches I and J are formed in membrane flaps H. The function of membrane flaps H and notches I and J are fully discussed in the aforementioned copending patent application.

CARTON ASSEMBLY

Figure 4:
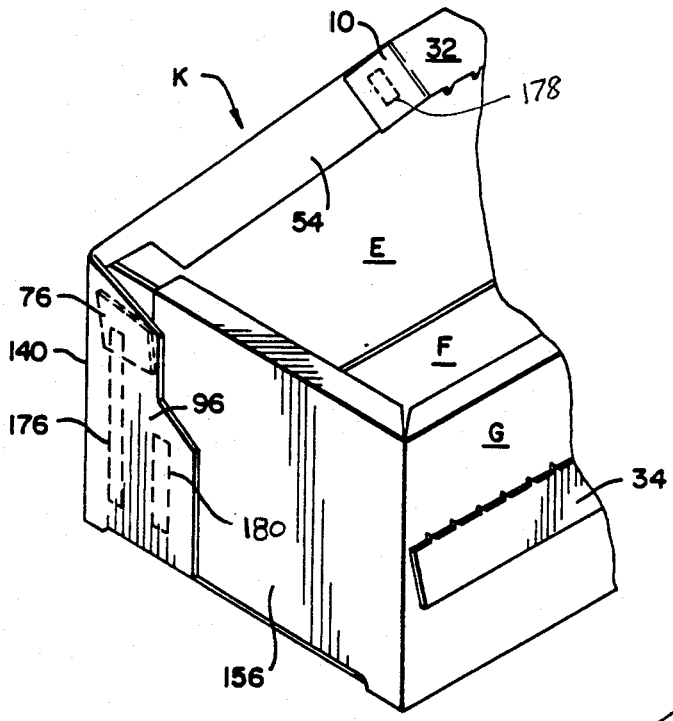
FIG. 4 is a fragmentary perspective view of the carton illustrated in FIG. 3 and further depicting the breakaway tab (shown in dotted lines) severed from the cover panel.

The steps taken to erect carton K, best seen in FIG. 2, will now be described. Front panel G is folded about hinge line 148 such that it overlays a portion of bottom panel end flap F. Subsequently, closure flap C and cover panel D are folded about hinge line 88 such that closure flap C overlaps front panel G and cover panel D overlaps rear panel E and bottom panel F. Pressure is applied to closure flap C to secure the same to front panel G. The blank A is then erected such that the front panel G, bottom panel F, rear panel E and cover panel D form a substantially rectangular shaped carton with their corresponding end flaps extending in the same horizontal plane. The end flaps are then folded in the following sequence to form the sealed carton K. The folding steps will be described with reference to only the left end of carton K. However, the right end of the carton is formed in an identical manner. The bottom panel end flap 130 is folded in first. Subsequently, the front panel end flap 156 is folded in. The cover panel end flap 54 is then folded in such that it overlays front panel 156 and bottom panel 130. An adhesive is then applied to the carton end, more specifically, a single strip of adhesive 176, as best seen in FIG. 4, is applied vertically along the bottom panel end flap 130 adjacent its rear edge 140. The glue strip 176 is extended such that it is applied to the outer surface of breakaway tab 76 formed in cover panel end flap 54. A second glue strip 178 is applied to the cover panel end flap 54 adjacent front edge 62. The adhesive strips 176 and 178 can be applied either simultaneously or consecutively. Further, an additional glue strip 180 can be applied along the bottom panel end flap 130 spaced from adhesive strip 176. The glue strip 180 is extended to cover a portion of front panel end flap 156. Once the glue strips have been applied, the rear panel end flap 96 and the glue tab 10 are simultaneously folded inwardly to for a sealed carton end. The adhesive strip 176 secures the exterior surface of breakaway tab 76 to rear panel end flap 96. Alternatively, or in addition to the above-mentioned glue patterns, the glue strip 176 can be extended along the bottom panel end flap 130 such that the inner surface (not shown) of breakaway tab 76 is secured to the bottom panel end flap 130.

CARTON OPENING AND RESEALING

Referring to FIG. 2, a consumer must remove tear strip 26 from closure flap C to gain access to the contents of carton K. Subsequently, the consumer will lift cover D in an upward direction from front panel G. As the cover D is lifted away from front panel G, breakaway tabs 76 will sever from corresponding cover panel end flaps 54 and 56. The bottom panel end flaps 130 and 132 and the corresponding rear panel end flaps 96 and 98 form a pocket for receiving the corresponding cover panels 54 and 56 in order to reseal the carton K. The rear edges 106 and first sections 112 define the longitudinal boundaries of the pockets formed by end flaps 96 and 98 and the corresponding end flaps 130 and 132. It is important to note that the breakaway tabs 76 are formed inwardly of top edges 66 of cover panel end flaps 54 and 56 such that a section 182 of cover panel end flaps 54 and 56 remains once the breakaway tabs 76 have been severed therefrom. Sections 182 are received in the pockets formed by the bottom panel end flaps 130 and 132, and the rear panel end flaps 96 and 98, for ensuring that the cover panel end flaps 54 and 56 remain in the folded position. Thus, once the carton K is resealed the end flaps 54 and 56 will resume their position prior to the opening of carton K.

The breakaway tabs 76 minimize the gap between the end flaps of the carton K to enhance the overall seal of the carton. Further, by eliminating the gaps between the end flaps forming the carton ends, a surface is formed which is significantly more desirable for displaying printed matter.

ALTERNATIVE EMBODIMENTS

Figure 5:
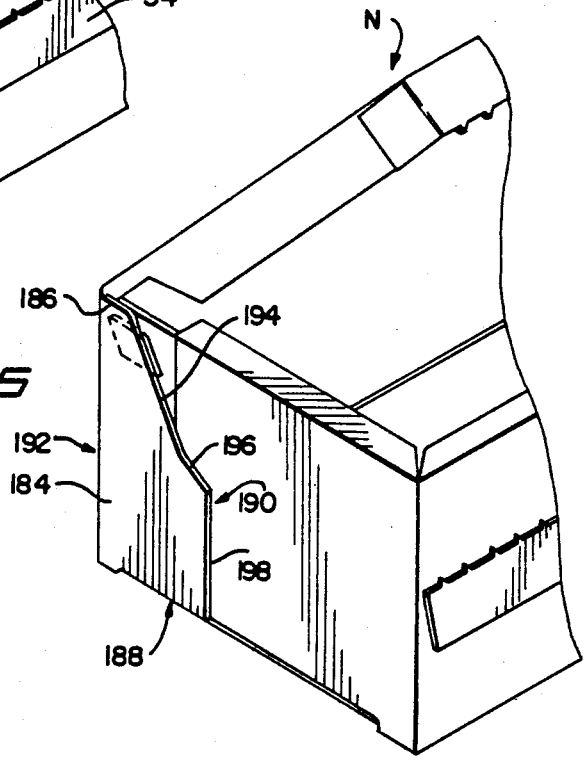
FIG. 5 is a fragmentary perspective view of a second embodiment formed in accordance with the present invention.

Referring to FIG. 5, the second embodiment of the present invention will now be described. The carton N depicted in FIG. 5, is identical to the carton K of FIG. 2 with the exception of rear panel end flaps 184 (only one is shown). The rear panel end flap 184 includes top edge 186, bottom edge 188, front edge 190 and rear edge 192. Bottom edge 188 and rear edge 192 are identical to bottom edges 110 and rear edges 106 of rear panel end flaps 96 and 98. Top edge 186 forms a right angle with rear edge 192. The front edge 190 of rear panel end flap 184 includes sections 194, 196 and 198. Section 194 forms an obtuse angle less than 180° with top edge 186. Section 196 forms an obtuse angle greater than 180° with first section 194. Section 198 forms an obtuse angle less than 180° with second section 196. Further, section 198 extends substantially parallel to rear edge 192. This particular configuration of rear panel end flap 184 improves the overall nesting of the blank A thereby minimizing the scrap material produced during the blanking operation.

Figure 6:
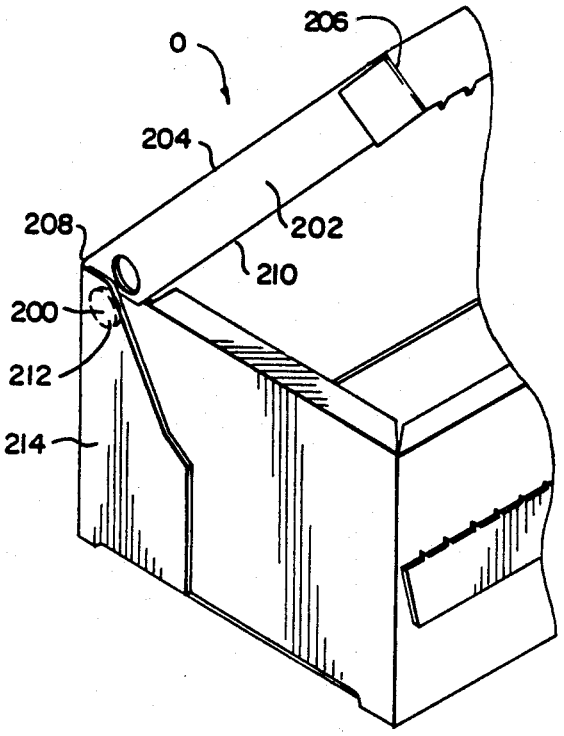
FIG. 6 is a fragmentary perspective view of a third embodiment formed in accordance with the present invention.

Referring to FIG. 6, the third embodiment of the present invention will now be described. The carton O depicted in FIG. 6 is identical to carton N, illustrated in FIG. 5, with the exception of breakaway tab 200. The breakaway tab 200 is formed in cover panel end flap 202. Cover panel end flap 202 includes top edge 204, front edge 206, rear edge 208 and bottom edge 210. The breakaway tab 200 is positioned inwardly of top edge 204, front edge 206, rear edge 208 and bottom edge 210. In positioning the breakaway tab 200 inwardly of all four edges of cover panel end flap 202, the outer perimeter of cover panel end flap 202 will remain in tacked and thus provide a tighter reseal for carton 0. As can be readily seen from FIG. 6, the outer surface 212 of breakaway tab 200 is glued to rear panel end flap 214 so that upon opening of the carton O, the breakaway tab 200 will sever from cover panel end flap 202.

Figure 7:
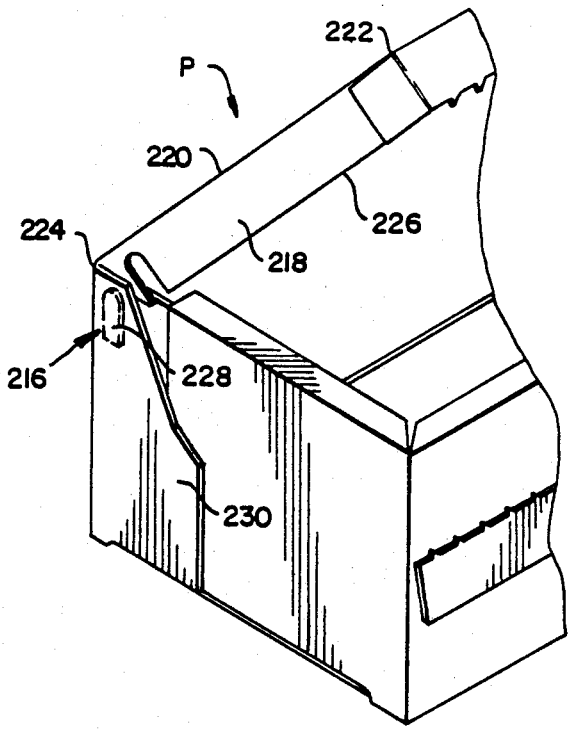
FIG. 7 is a fragmentary perspective view of a fourth embodiment formed in accordance with the present invention.

Referring to FIG. 7, the fourth embodiment of the present invention will now be described. The carton P, depicted in FIG. 7, is identical to the carton illustrated in FIG. 5 with the exception of breakaway tab 216. The breakaway tab 216 is substantially U-shaped and is formed in cover panel end flap 218. Cover panel end flap 218 includes top edge 220, front edge 222, rear edge 224 and bottom edge 226. Breakaway tab 216 is positioned inwardly of top edge 220, front edge 222 and rear edge 224. As can be readily seen from FIG. 7, the breakaway tab 216 is secured to rear panel end flap 230 at outer surface 228. Thus, upon opening of the carton P, the breakaway tab 216 will sever from the cover panel end flap 218.

Figure 8:
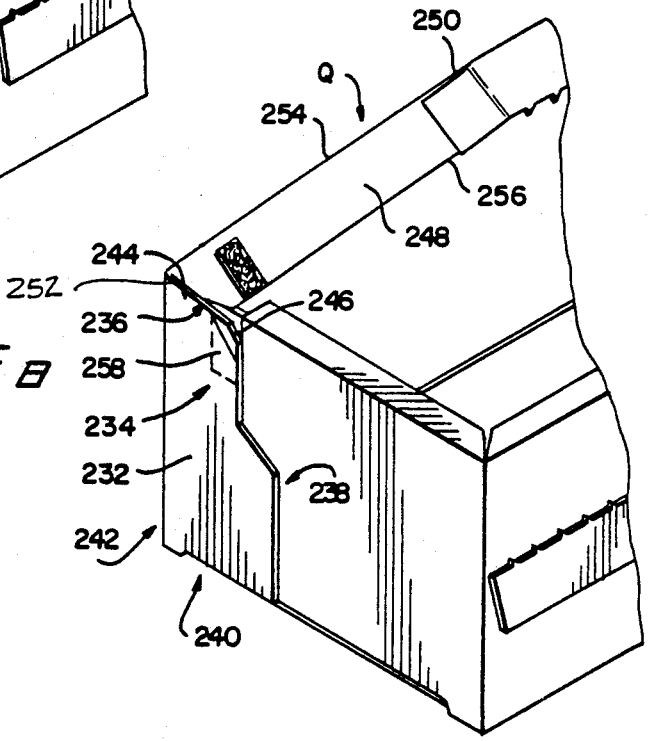
FIG. 8 is a fragmentary perspective view of a fifth embodiment formed in accordance with the present invention.

Referring to FIG. 8, the fifth embodiment of the present invention will now be described. The carton O, illustrated in FIG. 8, is similar to the carton K depicted in FIG. 2. The differences lie in the rear panel end flap 232 and the breakaway tab 234. Rear panel end flap 232 includes top edge 236, front edge 238, bottom edge 240 and rear edge 242. The front edge 238, bottom edge 240 and rear edge 242 are substantially identical to the corresponding edges 104, 110 and 106 of rear panel end flaps 96 and 98 of carton K. The top edge 236 includes first section 244 and second section 246. First section 244 forms an acute angle with rear edge 242. Second section 246, at one end, forms an obtuse angle less than 180° with first section 244. At the other end, second section 246 forms an obtuse angle less than 180° with front edge 238.

Breakaway tab 234 is formed in cover panel end flap 248. Cover panel end flap 248 includes front, rear, top and bottom edges 250, 252, 254 and 256. The breakaway tab 234 extends through only a portion of cover panel end flap 24B. Thus, unlike the previous embodiments, the notch, formed upon severing of the breakaway tab 234, does not extend through the cover panel end flap 248. This feature ensures a tighter reseal of carton Q once the tear strip (not shown) has been removed.

In this embodiment, the adhesive strip used to secure the breakaway tab 234 to the carton end must be applied to the outer surface 258 of the breakaway tab 234.

Referring to FIGS. 9–13, the final and sixth embodiment of the present invention will now be described. The carton R, illustrated in FIG. 9, is identical to the carton K depicted in FIG. 2, with the exception of breakaway tab 300. The breakaway tab 300 is substantially U-shaped and is formed in Cover panel end flap 302. As best shown in FIG. 10, the breakaway tab 300 includes two breakaway tab portions 304 and 306, having heights 305 and 307, respectively. The tab portion 306 has a height 307, which extends further toward cover panel top edge 308 than the height 305 of the tab portion 304. As can be readily seen from FIG. 10, the breakaway tab 300 is defined by a perforation cut or score line 310.

As shown in FIGS. 12 and 13, cover panel end flap 302 is made of a high-gloss upper surface laminate 312 and a lower base laminate 314. The score line 310 extends only through the thickness of the upper laminate 312, which is about one-fourth of the thickness of the cover panel end flap 302. In addition to top edge 308, cover panel end flap 302 includes front edge 316, rear edge 318 and bottom edge 320. Breakaway tab 300 is positioned inwardly of top edge 308, front edge 316 and rear edge 318. As can be readily seen from FIG. 11, the breakaway tab 300 is secured to rear panel end flap 322 at outer surface 324.

As described above, the breakaway tab 300 extends only through the thickness of the upper laminate 312, therefore, upon opening of carton R, the breakaway tab 300 is severed from the base laminate 314 of the cover panel end flap 302, and a notch 326 is formed. The notch 326 does not extend through the entire thickness of the cover panel end flap 302. This construction ensures a tighter reseal of carton R once the tear strip 328 (FIG. 9) is removed.

As described above and shown in FIG. 10, the breakaway tab 300 is formed of two breakaway tab portions 304 and 306. During carton assembly (described above), a single strip of adhesive or glue 330, shown in FIG. 11, is applied vertically along the bottom panel end flap 332 adjacent its rear edge 334. The glue strip 330 is extended such that it is applied to the outer surface 324 of the breakaway tab 300. Therefore, the breakaway tab 300 is firmly secured to the rear panel end flap 322, and when carton R is opened after tearing-up the strip 328, breakaway tab 300 is severed from the cover panel end flap 302.

However, it has been observed that the glue line 330 does not always extend up to about the full height 307 of the breakaway tab 300. Therefore, when the carton R is opened, the entire breakaway tab 300 does not sever from the cover panel end flap 302, and a portion thereof remains loosely attached to the cover panel end flap 302. This loosely attached portion has to be torn-off by the user or it makes it difficult to tightly reseal the carton.

In order to eliminate this problem, the breakaway tab 300 in the carton R of the present invention, is formed of two tab portions 304 and 306. As shown in FIG. 10, the breakaway tab portions 304 and 306 extend, toward top edge 308 of the cover panel end flap 302, to heights 305 and 307, respectively. Accordingly, if the glue line 330 does not extend up to about the full height 307 of the breakaway tab portion 306, and extends only up to the height 305 of the breakaway tab portion 304, the tab portion 304 may be easily severed about score line portion 336 of score line 310 (FIG. 10). Thus, the breakaway tab portion 306 is not at all affected and remains intact as a part of the cover panel end flap 302. Alternatively, if the glue line 330 does extend up to the height 307 of the breakaway tab portion 306, the entire breakaway tab 300 may be easily severed about score line 310 from the cover panel end flap 302.

The method for erecting the aforementioned alternative embodiments is identical to that of carton K.

While this invention has been described as having preferred design, it is understood that it is capable of further modification, uses and/or adaptation of the invention following in general the principle of the invention including such departure from the present disclosure as may come within the known or customary practice in the art to which the invention pertains, and as may be applied to the central features set forth and fall within the scope of the invention and of the limits of the appended claims.

What is claimed is:

1. A carton for packaging ice cream or the like, comprising:

(a) a receptacle, including operably connected front, bottom and rear panels;

(b) said front panel and rear panels each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) a cover including a cover panel having front, rear, left and right edges;

(g) said cover panel being operably connected at its rear edge to said top edge of said rear panel of said receptacle;

(h) said cover further including a closure flap operably connected to said front edge of said cover panel;

(i) means for securing said closure flap to said front panel;

(j) said panels of said receptacle each having left and right end flaps connected to said left and right edges respectively;

(k) said end flaps each having top, bottom, front and rear edges;

(l) said left end flaps of said receptacle and said cover being dimensioned to form a substantially sealed left end of said carton;

(m) said right end flaps of said receptacle and said cover being dimensioned to form a substantially sealed right end of said carton;

(n) at least one of said end flaps of said receptacle and said cover having a breakaway tab means including first and second surfaces;

(o) said first surface of said breakaway tab means being detachably connected to one of said at least one of said end flaps of said receptacle and said cover;

(p) said at least one of said end flaps of said receptacle and said cover including a surface laminate;

(q) said second surface of said breakaway tab means being fixed to the other of said at least one of said end flaps of said receptacle and said cover in order that said breakaway tab means is readily severed from said at least one of said end flaps of said receptacle and said cover upon initial opening of said carton; and (r) said breakaway tab means extending only through the thickness of said surface laminate of said at least one of said end flaps of said receptacle and said cover.

2. A carton as in claim 1, wherein:

(a) said breakaway tab means is substantially U-shaped.

3. A carton as in claim 1, wherein:

(a) said breakaway tab means including a first portion and a second portion releasably attached to said first portion.

4. A carton as in claim 3, wherein:

(a) said first portion of said breakaway tab means extending inwardly from at least three said edges of one of said cover, front, bottom and rear panel end flaps.

5. A carton as in claim 4, wherein:

(a) said first portion being greater in length than said second portion.

6. A carton as in claim 5, wherein:

(a) said first portion is substantially U-shaped.

7. A carton as in claim 5, wherein:

(a) said second portion is substantially U-shaped.

8. A carton as in claim 1, wherein:

(a) the thickness of said surface laminate is approximately one quarter of the thickness of said at least one of said end flaps.

9. A carton as in claim 1, wherein:

(a) said receptacle comprising a laminated material; and (b) said breakaway tab means being at least one laminate in thickness.

10. A carton as in claim 1, wherein:

(a) said breakaway tab means is formed in each of said left and right cover panel end flaps.

11. A carton as in claim 10, wherein:

(a) said breakaway tab means is positioned inwardly from at least three said edges of said left and right cover panel end flaps.

12. A carton as in claim 11, wherein:

(a) at least one of said left and right ends of said carton includes pocket means for reforming said carton subsequent to initial opening thereof; and (b) said pocket means is formed such that said rear panel end flap of at least one of said left and right ends of said carton forms an exterior portion of said pocket means and is operably associated with at least one other end flap of said at least one of said left and right ends of said carton forming an interior portion of said pocket means.

* * * * *